US007928658B2

(12) United States Patent
Yamakita

(10) Patent No.: US 7,928,658 B2
(45) Date of Patent: Apr. 19, 2011

(54) PLASMA DISPLAY PANEL

(75) Inventor: Hiroyuki Yamakita, Osaka (JP)

(73) Assignee: Panasonic Corporation, Osaka (JP)

( * ) Notice: Subject to any disclaimer, the term of this patent is extended or adjusted under 35 U.S.C. 154(b) by 398 days.

(21) Appl. No.: 11/910,038

(22) PCT Filed: Apr. 14, 2006

(86) PCT No.: PCT/JP2006/307984
§ 371 (c)(1),
(2), (4) Date: Sep. 28, 2007

(87) PCT Pub. No.: WO2006/112419
PCT Pub. Date: Oct. 26, 2006

(65) Prior Publication Data

US 2008/0252214 A1 Oct. 16, 2008

(30) Foreign Application Priority Data

Apr. 15, 2005 (JP) ..... 2005-118713

(51) Int. Cl.
*H01J 17/49* (2006.01)

(52) U.S. Cl. ..... 313/582; 313/584; 313/491; 345/60

(58) Field of Classification Search ..... 313/582–587, 313/491; 345/60
See application file for complete search history.

(56) References Cited

U.S. PATENT DOCUMENTS

| | | | | |
|---|---|---|---|---|
| 5,952,782 | A | 9/1999 | Nanto et al. | |
| 6,200,182 | B1 | 3/2001 | Nanto et al. | |
| 6,297,590 | B1 | 10/2001 | Nanto et al. | |
| 6,343,967 | B1 | 2/2002 | Nishiki et al. | |
| 6,479,932 | B1 * | 11/2002 | Nunomura | 313/582 |
| 6,727,870 | B1 * | 4/2004 | Kim et al. | 345/60 |
| 2004/0256989 | A1 * | 12/2004 | Kim et al. | 313/584 |
| 2006/0001354 | A1 * | 1/2006 | Chen et al. | 313/491 |
| 2006/0076891 | A1 * | 4/2006 | Kim | 313/584 |
| 2006/0097636 | A1 * | 5/2006 | Min | 313/582 |
| 2006/0108924 | A1 * | 5/2006 | Choi et al. | 313/582 |
| 2006/0232207 | A1 * | 10/2006 | Sugimoto et al. | 313/582 |
| 2007/0040497 | A1 * | 2/2007 | Yi et al. | 313/506 |

FOREIGN PATENT DOCUMENTS

| | | |
|---|---|---|
| CN | 1521795 | 8/2004 |
| JP | 4-75233 | 3/1992 |
| JP | 6-103903 | 4/1994 |
| JP | 7-65728 | 3/1995 |
| JP | 10-241577 | 9/1998 |
| JP | 11-40063 | 2/1999 |

(Continued)

*Primary Examiner* — Peter J Macchiarolo
*Assistant Examiner* — Mary Ellen Bowman

(57) ABSTRACT

An object of the present invention is to provide a high-definition PDP having a high luminance and low electric power consumption by keeping a line resistance of a bus electrode low and supplying enough electric power to a bus electrode edge in an extending direction of the bus electrode.

Therefore, in a PDP having a construction in which a barrier rib (14) for separating adjacent discharge cells (101) is provided so as to cross over a display electrode pair (4), a projection (91) is formed in a barrier rib crossing part (93) in which a bus electrode (9) crosses over the barrier rib (14). Then, a line width (D1) of the projection (91) is set to be larger than a line width (D2) of a discharge space part (92) facing to a discharge space. Also, a width (W1) of the projection (91) is set to be smaller than a maximum width (W2) of the barrier rib (14).

37 Claims, 8 Drawing Sheets

FOREIGN PATENT DOCUMENTS

| | | |
|---|---|---|
| JP | 2000-21313 | 1/2000 |
| JP | 2000-243297 | 9/2000 |
| JP | 2002-373596 | 12/2000 |
| JP | 2002-170507 | 6/2002 |
| JP | 2003-123654 | 4/2003 |
| JP | 2004-39575 | 2/2004 |
| JP | 2005-60562 | 3/2005 |
| WO | WO 2005088668 A1 * | 9/2005 |

* cited by examiner

PLASMA DISPLAY PANEL

TECHNICAL FIELD

The present invention relates to a plasma display panel for displaying an image using radiation by a gas discharge, and especially relates to a high-definition plasma display panel.

BACKGROUND ART

A plasma display panel (hereinafter, referred to as "PDP") is a gas discharge display device having the following construction. In a PDP, a front panel in which a plurality of display electrode pairs are set, and a back panel in which a plurality of data electrode pairs which are writing electrodes are set, are arranged. The front panel and the back panel are arranged so that the display electrode pairs cross over the data electrode pairs. Discharge cells are arranged in a matrix by enclosing a discharge gas dischargeable in a discharge space in a display area so that a discharge space is provided between both substrates of the front panel and the back panel.

FIG. 6 is a schematic perspective view showing a construction of a discharge cell in a display area of an AC-type PDP according to a conventional technology. FIG. 6 is partially broken to show an internal construction, in which four discharge cells are arranged in parallel with each other.

In the PDP shown in FIG. 6, a front panel 2 and a back panel 3 are arranged in opposition to each other. A display electrode pair 4 composed of a scan electrode 5 and a sustain electrode 6 is arranged on a glass substrate 10 of the front panel 2. Also, a dielectric layer 7 and a protection film 8 which is composed of MgO (magnesium oxide) and the like are formed so as to cover the display electrode pair 4. On the other hand, a data electrode 12 for writing display information is formed on a substrate 11 of the back panel 3, and a dielectric layer 13 is formed so as to cover the data electrode 12. A barrier rib 14 is formed on the dielectric layer 13 so as to be located between adjacent discharge cells in parallel with the data electrode 12. A phosphor layer 15 for RGB is formed on a surface of the dielectric layer 13 and a side of the barrier rib 14 for each discharge cell.

The data electrode 12 and the barrier rib 14 are arranged so as to cross over the display electrode pair 4. A discharge cell which is a pixel unit is formed in an area in which the data electrode 12 crosses over the display electrode pair 4. A mixed gas of Ne (neon) and Xe (xenon) and the like as a discharge gas is filled in a discharge space 1 at a pressure of several tens of kPa.

When driving a PDP, an image is displayed by the following operation. In a display period after a data writing period, an AC voltage is applied between the scan electrode 5 and the sustain electrode 6 composing the display electrode pair 4 with a discharge gap G therebetween to selectively generate a discharge in a discharge cell. The phosphor layer 15 is excited by an ultraviolet ray radiated from a Xe atom and a Xe molecule which are excited by the discharge, thereby generating visible light.

As shown in FIG. 6, in a plan view, the scan electrode 5 and the sustain electrode 6 are extended in a direction perpendicular to the barrier rib 14 in a stripe state, and each of the scan electrode 5 and the sustain electrode 6 is composed of a transparent electrode 55 and a bus electrode 59 for electric power supply.

The transparent electrode 55 has a high light transmittance, and is formed on the glass substrate 10 in a substantially large width in parallel with the other transparent electrode 55, with the discharge gap G therebetween. A projection which projects toward the discharge gap D may be formed on the transparent electrode 55 by patterning. A material having a relatively high resistance and high visible light transmittance, such as ITO (Indium Tin Oxide), $SnO_2$ (NESA), and the like, is used as a material of the transparent electrode 55. The transparent electrode 55 is formed by a thin film process such as deposition, CVD, and the like.

The bus electrode 59 is a belt-like metal electrode having a low line resistance, and is formed on the transparent electrode 55 so as to be thinner than the transparent electrode 55. A material having a relatively low resistance, such as Ag (silver), Al (aluminum), Cu (copper), or a laminated film of Cr (chrome) and Cu, is used as a material of the bus electrode 59. There are a wide variety of formation methods of the bus electrode 59. One example of the formation methods is a thick film process in which a thick film electrode is formed using a print calcination process by a thick film electrode material such as an Ag electrode paste that is mixed with an organic binder material. The formation methods also include a thin film forming process using a thin film electrode material including Al, Cu, and the like, and a thin film process in which a thin film electrode is formed by patterning using a photolithographic process.

The above-mentioned PDP tends to be higher in definition. For example, a full high-definition class (1920×1080) has been developed.

Patent Document 1: Japanese Published Patent Application No. 2003-123654

DISCLOSURE OF THE INVENTION

Problems the Invention is Going to Solve

In a low-definition PDP, the bus electrode 59 of the display electrode pair 4 is formed in a width of about 100 μm, as an example. Therefore, even if the electrode is long, a voltage drop is not so large. As a result, in a display area of the PDP, a luminance difference between an electric power supply side and an edge side is not less likely to be caused, and luminance uniformity in a panel surface can be ensured. However, in the case of a high-definition PDP, the following problem arises as a first problem. Since a pixel area becomes smaller than a conventional technology, a pixel aperture ratio becomes low if an electrode width is the same as in the conventional technology. Therefore, thinner bus electrode is required to ensure a pixel aperture ratio. However, if a fine pattern of a bus electrode is formed using the conventional bus electrode material and the conventional electrode formation process, a line resistance in a longitudinal direction increases, making it difficult to sufficiently supply electric power to an electrode edge in an extending direction.

To solve the above-mentioned problem, FIGS. 4 and 12 of the patent document 1 disclose a belt-like bus electrode, formed on a substrate, whose line width is smaller on a downstream side than on an upstream side (electrode draw-out side) in a power supplying direction.

FIG. 7 is a schematic plan view showing a construction of the bus electrode in and outside a display area of a PDP of the patent document 1. The same numbers as in FIG. 6 are assigned to the same component parts, and a part of the construction is omitted for simplification.

As shown in FIG. 7, in the PDP of the patent document 1, a line width of a bus electrode 69 is set to be larger on an upstream side in a power supplying direction than on a downstream side in a display area A. This enables a resistance on the upstream side in the power supplying direction to be decreased, and electric power consumption in the electrode to be reduced.

Next, a sealing part of a PDP and an electrode draw-out part which is drawn from a bus electrode will be described.

FIG. 8 is a schematic plan view showing a construction of an electrode draw-out part from a bus electrode in a conventional PDP. The same numbers as in FIGS. 6 and 7 are assigned to the same component parts, and a part of the construction is omitted for simplification.

In FIG. 8, an area B shows an enlarged area around a sealing crossing part 72 in which an electrode draw-out part 71 crosses over a sealing part 70 formed by a glass frit and the like. The electrode draw-out part 71 is formed by being drawn from the bus electrode 59 in FIG. 6 or the bus electrode 69 in FIG. 7 to an outside of a display area A.

As shown in the area B of FIG. 8, the bus electrode 59 (69) is extended to an inside of the display area A, and the electrode draw-out part 71 from the bus electrode 59 (69) is extended to an outside of the display area A. This electrode draw-out part 71 passes through the sealing part 70 and extends to outside. A line width of the electrode draw-out part 71 is same or larger than a line width D2 of the bus electrode 59 (69) on the display area A side. Also, the electrode draw-out part 71 crosses over the sealing part 70 which is provided on a periphery portion of the substrate in the sealing crossing part 72, and extends to a direction of an external drive circuit connection part (not illustrated) which is provided at a substrate edge (not illustrated) for electric power supply.

It is difficult to solve the above-mentioned first problem only by the technology disclosed in the patent document 1. Especially in a high-definition PDP with a large screen, since a line length of a bus electrode is considerably long, it is hard to ensure an image quality of a high-definition PDP with a large screen.

Also, in the case of a high-definition PDP, the following problem arises as a second problem. As an arrangement pitch of a bus electrode is smaller, an interval between adjacent electrode draw-out parts is smaller. This causes a migration phenomenon in the electrode draw-out parts.

For example, in order to realize a high-definition PDP for full high definition, each of the number of scan electrodes and the number of sustain electrodes is required to be increased to about 2000, and an arrangement pitch P of a bus electrode is required to be smaller than about one third of a conventional pitch.

In a conventional low-definition PDP, an arrangement pitch of the bus electrode 59 is about 270 μm, and an interval g2 between sealing crossing parts 72 is about 170 μm. On the other hand, if the number of the bus electrodes 59 is about 2000×2 as in the above case of a high-definition PDP, an arrangement pitch P2 of the bus electrode 59 needs to be reduced to about 80 μm, and the line width D2 of the electrode draw-out part 71 is required to be about 70 μm. In this case, if a line width D21 of the sealing crossing part 72 is same as the line width D2 (about 70 μm), the interval g2 between the sealing crossing parts 72 is about 10 μm which is extremely narrow.

As mentioned above, if an interval between electrode draw-out parts 71 is narrow, a large electric field occurs in the interval when driving a PDP. As a result, an electromigration phenomenon is caused between the adjacent sealing crossing parts 72, and an electric current leak occurs through the sealing part 70. Therefore, electric power consumption becomes large and a crack may occur because of a deterioration of a sealing part. If a crack occurs in a sealing part, a gas leak occurs. This causes panel reliability degradation.

In view of these, a main object of the present invention is to provide a high-definition PDP with a large screen having a high luminance and low electric power consumption, by ensuring a pixel aperture ratio and keeping a line resistance of a bus electrode low in order to supply enough electric power to a bus electrode edge in an extending direction of the bus electrode. Also, another object of the present invention is to improve reliability of a PDP by preventing a migration phenomenon in an electrode draw-out part.

Means of Solving the Problems

To solve the above-mentioned problems, the following measures are employed in the present invention.

(1) In a PDP having a construction in which a barrier rib for separating adjacent discharge cells is arranged so as to cross over a display electrode, a projection is provided in a part of a bus electrode of the display electrode, in which the bus electrode crosses over and overlaps with the barrier rib. The projection is formed so that a line width of the bus electrode is larger in a part that includes the projection than in a part that faces a discharge space, and a width of the projection is set to be equal to or smaller than a maximum width of the barrier rib.

Here, a "line width" indicates a bus electrode width in a direction perpendicular to a bus electrode extending direction, and a "width" of a projection indicates a horizontal width of a projection in the bus electrode extending direction (width in the bus electrode extending direction).

Also, the state in which "a barrier rib is arranged so as to cross over a display electrode" is that the barrier rib and the display electrode cross with each other when viewed from a front of the PDP. The state includes both cases in which the barrier rib crosses over the display electrode in contact with each other, and the barrier rib crosses over the display electrode in non-contact with each other. Moreover, "a part of a bus electrode in which the bus electrode crosses over and overlaps with a barrier rib" is an overlapping part when viewed from the front of the PDP.

(2) In a PDP having a construction in which a light shielding film for shielding light in a boundary area between adjacent discharge cells is arranged so as to cross over a display electrode, a projection is provided in a part of a bus electrode of the display electrode, in which the bus electrode crosses over and overlaps with the shielding film. The projection is formed so that a line width of the bus electrode is larger in a part that includes the projection than in a part that faces a discharge space, and a width of the projection is set to be equal to or smaller than a width of the shielding film.

Here, the state in which "a shielding film is arranged so as to cross over a display electrode" is that the shielding film and the display electrode cross over with each other when viewed from a front of the PDP. The state includes both cases in which the shielding film crosses over the display electrode in contact with each other, and the shielding film crosses over the display electrode in non-contact with each other.

In the PDPs mentioned in the above (1) and (2), it is preferable that a line width (vertical width) of the bus electrode in a part that includes the projection is in a range of twice to 20 times inclusive as large as the line width of the bus electrode in a part that faces a discharge space.

When a bus electrode is laminated on a belt-like transparent electrode, it is preferable that a projection of each display electrode is extended to an edge of the transparent electrode on a discharge gap side.

(3) In a PDP having an electrode draw-out part which is formed by drawing a bus electrode from an inside of a display area to an outside of the display area across the sealing part, a line width of a part of the electrode draw-out part of the bus electrode in which the electrode draw-out part crosses over the sealing part is set to be smaller than a line width of the inside of the display area.

In the PDP mentioned in the above (3), it is preferable that at least the part of the electrode draw-out part across the sealing part is composed of a thin film which is formed by an electrode material including at least one material selected from the group consisting of Al (aluminum), Cu (copper), Cr (chrome), Ni (nickel), Au (gold), and Pd (palladium).

Also, it is preferable that the line width of the part of the electrode draw-out part across the sealing part is in a range of 5 μm to 10 μm inclusive.

Moreover, it is preferable that the sealing part is formed by a composite material including an organic material and an inorganic material.

Furthermore, it is preferable that the sealing part which crosses over and contacts with at least the electrode draw-out part is formed by a composite material including an organic material and an inorganic material.

Also, it is preferable that the sealing part is formed by a low temperature process in a range of a room temperature (25° C.) to 300° C. inclusive.

In the PDPs mentioned in the above (1), (2), and (3), it is preferable that the bus electrode is formed by a thin film which is composed of an electrode material including at least one material selected from the group consisting of Al (aluminum), Cu (copper), Cr (chrome), Ni (nickel), Au (gold), and Pd (palladium), or by a thick film which is composed of an electrode material including Ag (silver).

Note that the present invention is not limited to the above-mentioned constructions, and it is possible to combine each of the constructions with each other.

EFFECTS OF THE INVENTION

With the above-stated construction of the PDP (1), a part of the bus electrode that faces the discharge space is a thin line, as a result, a decline of a pixel aperture ratio can be prevented, and a lower resistance of the bus electrode in the projection having a large line width can be realized. Also, since the width of the projection is set to be equal to or smaller than the maximum width of the barrier rib, the projection does not shield a light emission from a discharge cell.

As a result, enough electric power can be supplied to a bus electrode edge in a bus electrode extending direction by keeping a line resistance of the bus electrode low while ensuring a pixel aperture ratio. Therefore, a high-definition PDP having a high luminance can be realized.

In the PDP (1) mentioned above, in order to achieve such effect, it is not necessarily that a width from a tip part to a root part of the whole projection is equal to or smaller than the maximum width of the barrier rib. The width may be partially larger than the maximum width.

For example, if the width in the tip part of the projection is set to be smaller than the maximum width of the barrier rib, the above-mentioned effect can be achieved. In this case, it is preferable to set the width in the root part of the projection to be larger than the maximum width of the barrier rib.

In order to ensure a pixel aperture ratio, it is preferable to project the projection along the barrier rib because the projection overlaps with the barrier rib even if being largely projected.

If a display surface of the bus electrode is formed by a low reflectance material for visible light, a contrast improvement effect can be achieved.

With the above-stated construction of the PDP (2), a part of the bus electrode that faces the discharge space is a thin line, as a result, a decline of a pixel aperture ratio can be prevented, and a lower resistance of the bus electrode in the projection having a large line width can be realized. Also, since the width of the projection is equal to or smaller than the width of the light shielding film, the projection does not shield a light emission from a discharge cell. As a result, enough electric power can be supplied to a bus electrode edge in a bus electrode extending direction by keeping a line resistance of the bus electrode low while ensuring a pixel aperture ratio.

In the PDP (2) mentioned above, in order to achieve such effect, it is not necessarily that the width from a tip part to a root part of the whole projection is set to be equal to or smaller than the maximum width of the barrier rib. The width may be partially larger than the maximum width of the barrier rib. For example, if the width in the tip part of the projection is set to be smaller than the width of the light shielding film, the above-mentioned effect can be achieved. In this case, it is preferable to set the width in the root part of the projection to be larger than the width of the light shielding film.

In order to ensure a pixel aperture ratio, it is preferable to project the projection along the light shielding film because the projection overlaps with the light shielding film even if being largely projected.

With the above-stated construction of the PDP (3), a line width in a part of the electrode draw-out part of the bus electrode in which the electrode draw-out part crosses over the sealing part is set to be smaller than a line width of the inside of the display area. Therefore, a resistance of the bus electrode can be kept low, and an interval of sealing crossing parts of the electrode draw-out part can be ensured. Thus, occurrence of an electromigration phenomenon, an electric current leak, and a gas leak in the sealing crossing part can be prevented. As a result, electric power consumption can be reduced, and reliability can be improved in a high-definition PDP.

DESCRIPTION OF REFERENCE NUMERALS

Figure 1:
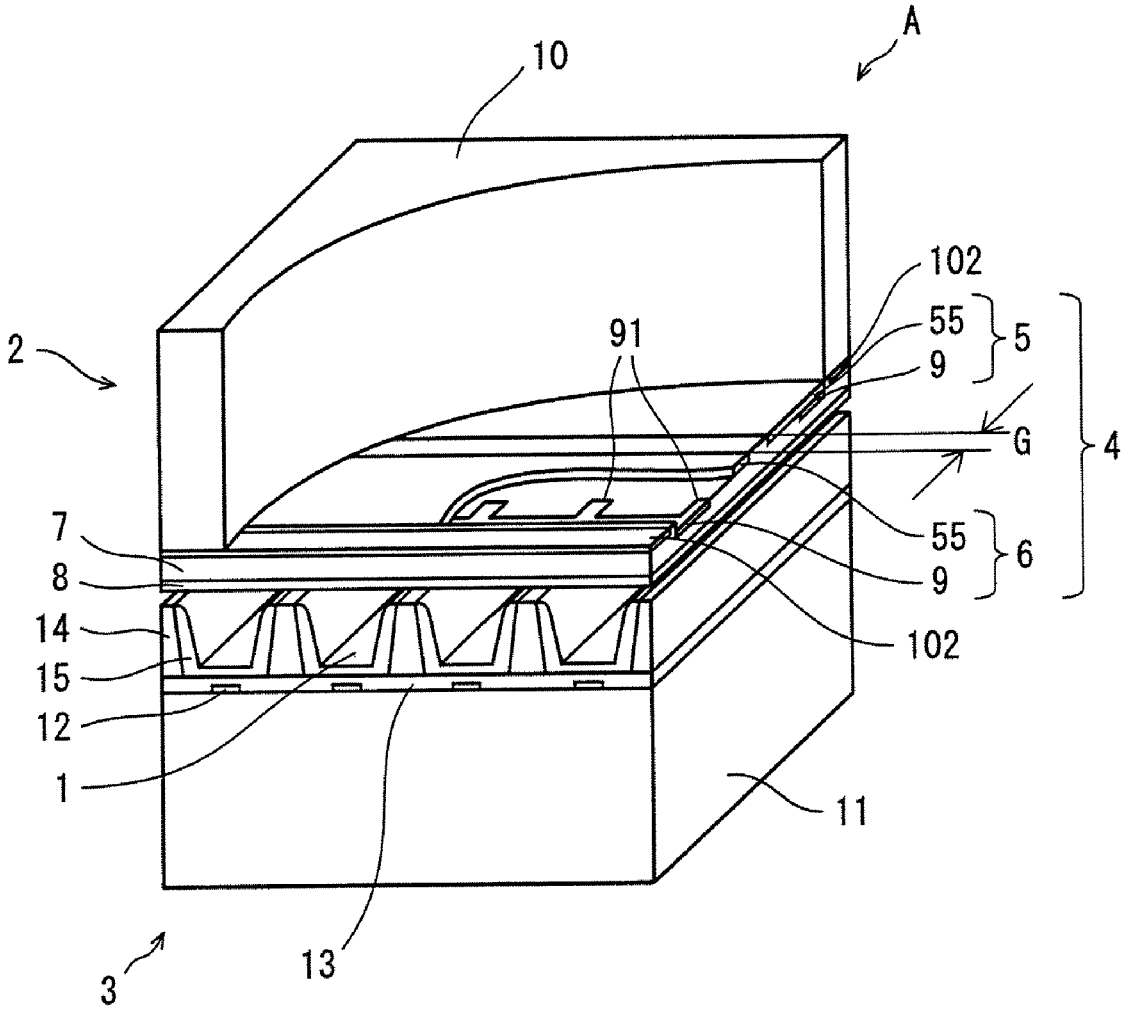
FIG. 1 is a schematic perspective view showing a construction of a discharge cell in a display area in a PDP of a first embodiment of the present invention.

1: discharge space
2: front panel
3: back panel
4: display electrode pair
5: scan electrode
6: sustain electrode
7: dielectric layer
8: protection film
9: bus electrode
10: glass substrate
11: glass substrate
12: data electrode
13: dielectric layer
14: barrier rib
15: phosphor layer
31: PDP
32: sealing part
33: electrode draw-out part
34: sealing crossing part
91: projection
92: discharge space part
93: barrier rib crossing part
94: projection
95: discharge space part
96: light shielding film crossing part
101: discharge cell
102: light shielding film
103: light shielding film
141: barrier rib
201: discharge cell

BEST MODE FOR CARRYING OUT THE INVENTION

The following describes a plasma display panel according to preferred embodiments of the present invention, with reference to the attached drawings.

First Embodiment

FIG. 1 is a schematic perspective view showing a construction of a discharge cell in a display area in a PDP of a first embodiment. In FIG. 1, four discharge cells are arranged in parallel with each other. In fact, in the PDP, a plurality of cells which emit each of colors of red, green, or blue are arranged. FIG. 1 is a partially cutaway view in order to show an internal construction.

Figure 2A:
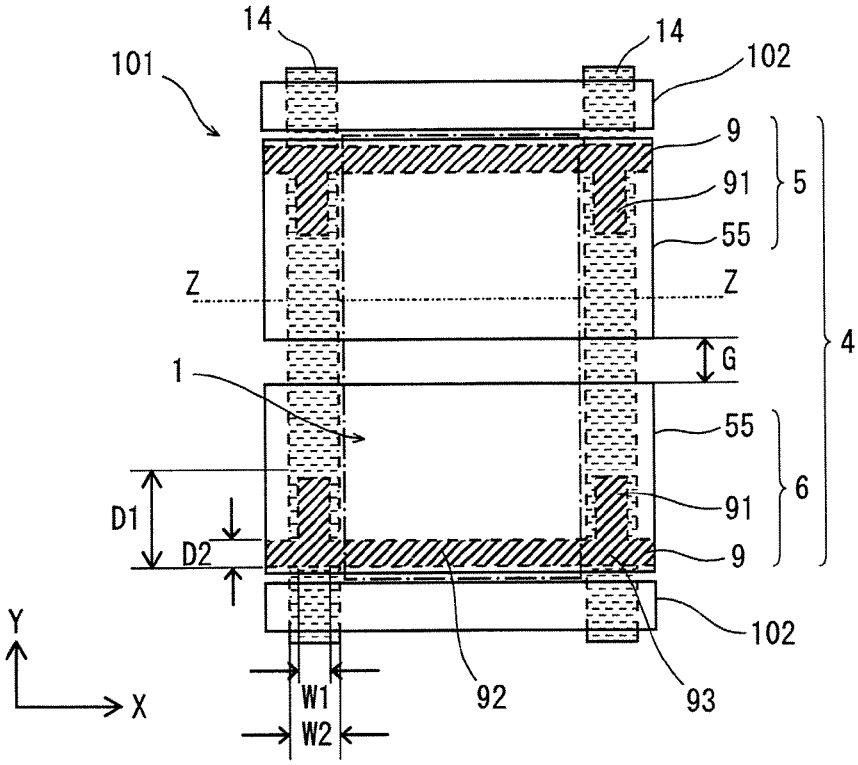
FIG. 2 is a schematic plan view showing a construction example of a discharge cell unit of the PDP of the first embodiment of the present invention.
Figure 2B:
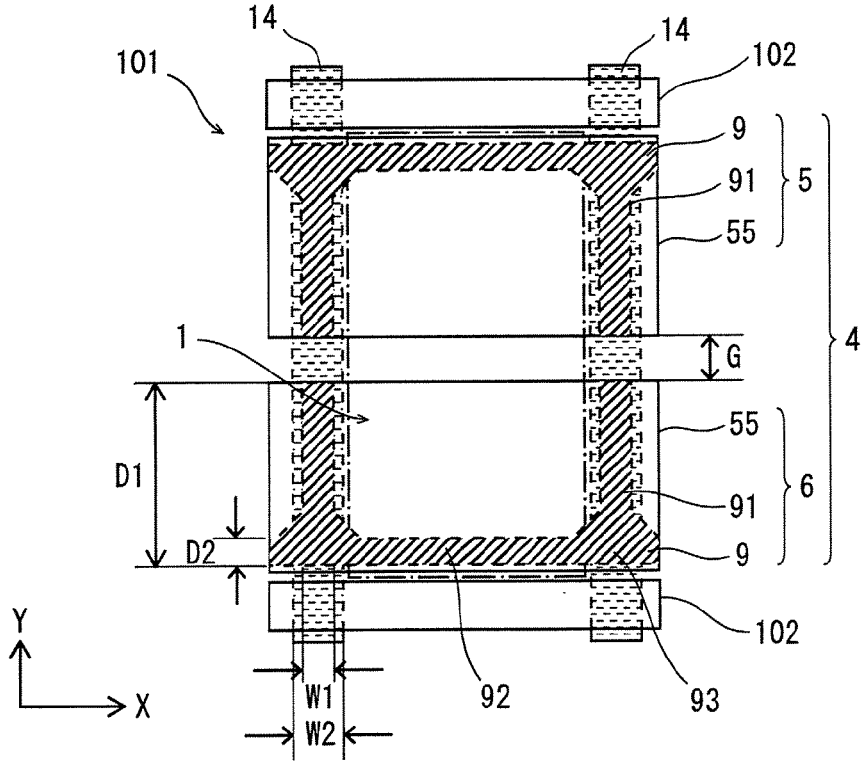

Each of FIGS. 2A and 2B is a schematic plan view showing a construction example of a discharge cell unit of the PDP of the first embodiment. In each of FIGS. 2A and 2B, only a discharge cell 101 is shown, and a display electrode construction of a front panel and a positional relationship between the display electrode and a barrier rib of a back panel, when viewed from a front panel, are shown.

Figure 6:
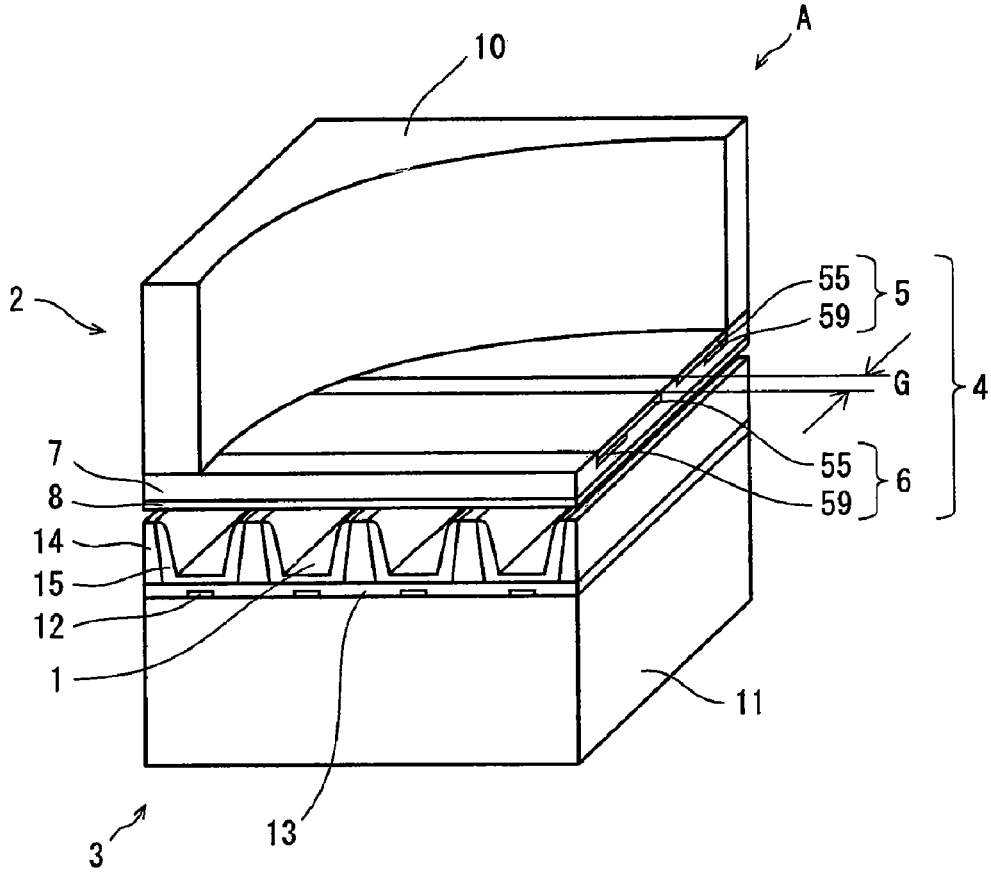
FIG. 6 PRIOR ART
FIG. 6 is a schematic perspective view showing a construction of a discharge cell in a display area in a PDP of a conventional technology.
Figure 7:
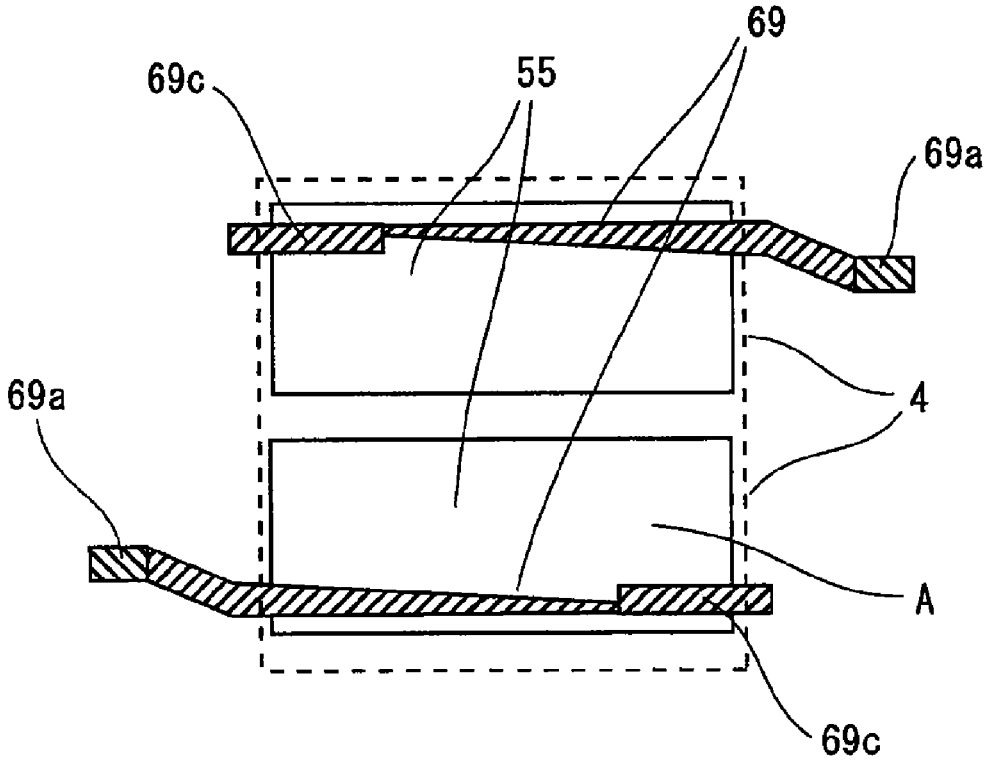
FIG. 7 PRIOR ART
FIG. 7 is a schematic plan view showing a construction of a bus electrode of an inside and an outside of a display area of the PDP of the conventional technology.
Figure 8:
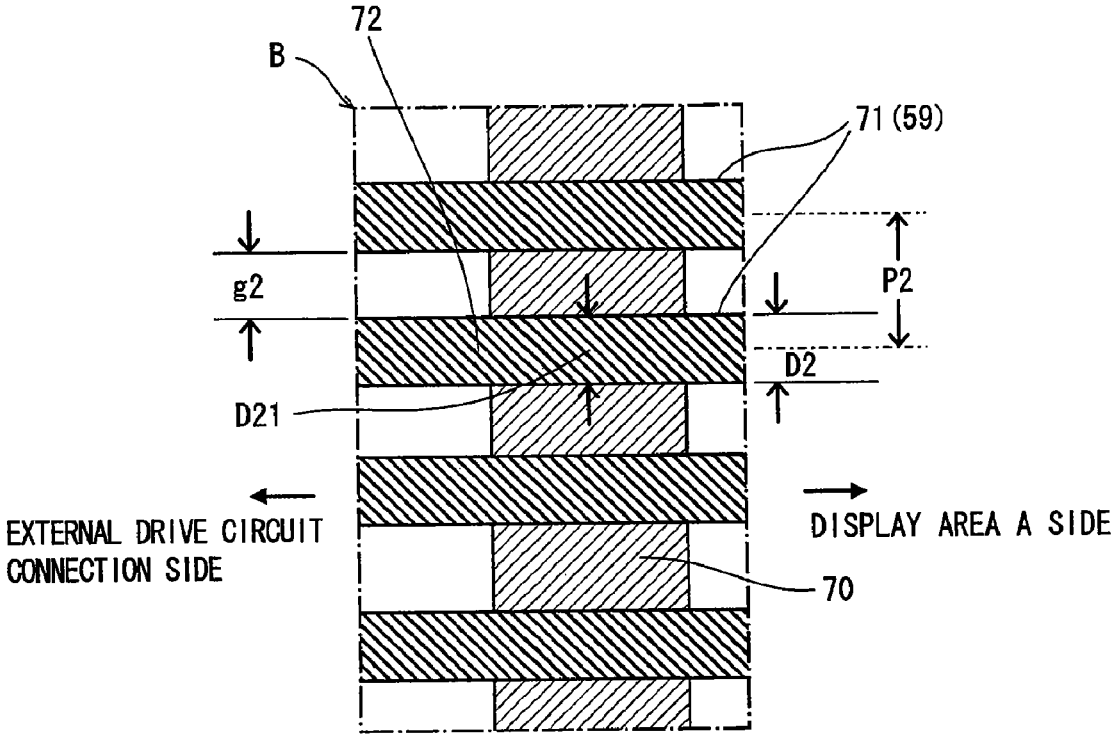
FIG. 8 PRIOR ART
FIG. 8 is a schematic plan view showing a construction of an electrode draw-out part from a bus electrode in a sealing part of the PDP of the conventional technology.

In FIGS. 1 and 2, the same numbers as in FIGS. 6 and 7 are assigned to the same component parts.

This PDP is a high-definition PDP for full high definition, for example, and has the following construction.

The front panel 2 and the back panel 3 are arranged in opposition to each other with the discharge space 1 therebetween.

On the substrate 10 of the front panel 2, the display electrode pair 4 which is composed of the scan electrode 5 and the sustain electrode 6 is arranged, and the dielectric layer 7 is formed so as to cover the display electrode pair 4. On the dielectric layer 7, the protection film 8 is formed. The protection film 8 is composed of a transparent MgO (magnesium oxide) having high secondary electron emission efficiency and a high sputtering resistance.

On the substrate 11 of the back panel 3, the data electrode 12 is formed, and the dielectric layer 13 is formed so as to cover the data electrode 12. On the dielectric layer 13, the barrier rib 14, which is a stripe shape or a curb shape is formed between adjacent discharge cells in parallel with the data electrode 12. The phosphor layer 15 for RGB is formed on a surface of the dielectric layer 13 and a side of the barrier rib 14 for each discharge cell.

The data electrode 12 and the barrier rib 14 are arranged so as to cross over the scan electrode 5 and the sustain electrode 6. A discharge cell which is a pixel unit is formed in the crossing part. In the discharge space 1, a mixed gas such as Ne (neon), Xe (xenon), and the like as a discharge gas is filled at a pressure of several tens of kPa. Since adjacent discharge cells are separated by the barrier rib 14, an erroneous discharge and optical crosstalk can be prevented when driving the PDP.

A manufacturing method of the above-mentioned PDP will be described.

Firstly, the display electrode pair 4 is formed by laminating the transparent electrode 55 and the bus electrode 9 as follows. On an inner surface of the glass substrate 10, a transparent electrode pair 55 is formed by performing pattering formation so that a transparent electrode film having a film thickness of about 1000 Å (100 nm) is widely formed by ITO (Indium Tin Oxide), $SnO_2$ (tin oxide, NESA), ZnO (zinc oxide), and the like. The transparent electrode pair 55 is arranged on an inner surface of the front panel 2 so as to extend to a panel longitudinal direction (X direction), and each formed in opposition to each other with a discharge gap G therebetween in a discharge cell. The discharge gap G is set in a range of 50 μm to 100 μm inclusive in order to cause the PDP to discharge at a low voltage when driving the PDP.

On this transparent pair 55 (discharge space side), the bus electrode 9 for lowering an electric resistance is laminated. Then, a projection 91 is formed in a part of the bus electrode 9 in which the bus electrode 9 crosses over the barrier rib 14 in a thin film electrode display area A as described later.

A part of the bus electrode 9 in the display area A is formed by a dense material having a low line resistance. For example, the electrode may be formed by a thick film method in which an Ag material is calcined. However, for high definition, it is preferable that the electrode is formed by a metal electrode thin film such as Al—Nd (aluminum-neodymium), Al—Zr (aluminum-zirconium), and the like which are composed of an Al series electrode material including a small amount of rare-earth metal, or a laminated electrode thin film such as Cr/Cu/Cr. Also, a thin film electrode may be formed by an electrode material including at least one material selected from the group consisting of Al (aluminum), Cu (copper), Cr (chromium), Ni (nickel), Au (gold), and Pd (palladium). By using these metal thin film electrode materials, a dense thin film electrode having a low line resistance can be formed. In addition, it is suitable for a high-definition PDP because minuter patterning than a thick film electrode can be performed.

The thin film formation process is performed in vacuum and the like. In the thin film formation process, a thin film having a thickness in a range of 0.1 μm to 4 μm inclusive is preferably formed, and then, a long and thin pattern is performed on the thin film by a photolithography technology.

As shown in FIG. 2, on a surface of the substrate 10, a black stripe-shaped light shielding film 102 may be formed in a X direction in parallel with the bus electrode 9, in order to shield light near a boundary between discharge cells adjacent to each other in a Y direction (panel longitudinal direction). If the light shielding film 102 is formed, the light shielding film 102 is formed between the bus electrode 9 and a bus electrode of an adjacent discharge cell (not illustrated).

Regardless of whether the light shielding film 102 is formed or not, it is preferable that a display surface side of an electrode is formed by a material having a low reflectance for visible light, when the bus electrode 9 is formed. Especially, it is preferable to use a black electrode material. As mentioned above, when the display surface side of the bus electrode 9 is formed by a low reflectance material, outside light entering to the barrier rib 14 is shielded if a high reflectance material is used for the barrier rib 14. Therefore, unnecessary light can be reduced and a contrast can be improved when driving the PDP. As a black electrode material for a thin film method, Cr or Ni can be used. Also, as a black electrode material for a thick film method, Ag containing a black conductive material can be used.

Then, the dielectric layer 7 is formed so as to cover the display electrode pair 4, the light shielding film 102, and the glass substrate 10. Also, on the dielectric layer 7, the protection film 8 having high secondary electron emission efficiency is formed.

When the dielectric layer 7 is formed, a thick film dielectric layer may be formed by a dielectric formation process in which calcinations is performed by a low-melting glass. However, if a dielectric layer material including TEOS (tetraethoxysilane) is used, in a low-temperature process in a range of a room temperature to 300° C. inclusive such as a CVD method (chemical vapor deposition method), a dense dielectric layer such as $SiO_2$ having a thickness in a range of 1 μm to 10 μm inclusive, and a low dielectric constant can be formed. Also, if an ICP-CVD method (inductively-coupled plasma CVD method) is used, denser dielectric layer having a lower dielectric constant can be formed at a high speed.

As a material of the protection film 8, a transparent material having high secondary electron emission efficiency and a high sputtering resistance, such as a MgO metal oxide is used. Also, the protection film 8 may be formed so as to have a thickness of several thousands of Å by a vacuum film formation technology such as a vacuum deposition method and a sputtering method.

On the other hand, on an inner surface of the glass substrate 11 of the back panel 3, the data electrode 12 is formed. As an electrode material of the data electrode 12, Ag (silver), Cr (chromium), Cu (copper), Ni (nickel) are used. If necessary, a combination of these materials may be used. Also, same as the formation of the above-mentioned bus electrode, a thin film electrode may be formed by using a thin film electrode material such as an Al series electrode material.

Then, on an inner surface of the back panel 3, the dielectric layer 13 is formed by a low-melting glass so as to cover the data electrode 12. Also, on the dielectric layer 13, a low-melting glass material is applied and calcined. Then, the low-melting material is made into a rib shape by using a sandblasting method or a photolithographic method in order to form the barrier rib 14. The barrier rib 14 is formed in a stripe or curb shape in a screen longitudinal direction (Y direction) so as to separate discharge cells.

Next, in the back panel 3 on which the barrier rib 14 is formed, the phosphor layer 15 of each of colors of red, green, and blue is formed on a side of the barrier rib 14 and a surface of the dielectric layer 13. The phosphor layer 15 is formed through a print process, an application process, and a calcination process for each phosphor color by using three colors phosphors such as (Y, G, d) $BO_3$:Eu, $Zn_2SiO_4$:Mn, and $BaMg_2Al_{14}O_{24}$:Eu.

Then, the front panel 2 having the display electrode pair 4, the dielectric layer 7, the protection film 8, and the like, and the back panel 3 having the barrier rib 14, the phosphor layer 15, and the like are arranged in opposition to each other with the discharge space 1 therebetween. Then, the front panel 2 and the back panel 3 are sealed with a sealing material in a periphery of the substrate to form an emission plate envelope. After that, an inside of the emission plate envelope is exhausted to make a high-vacuum state, and as a discharge gas, a rare mixed gas including xenon and neon which is a rare gas is enclosed in the emission plate envelope at a pressure of about 60 kPa. As a result, a high-definition PDP can be manufactured.

Note that when the above-mentioned PDP is sealed, the sealing process and the enclosing process can be performed at the same time in the mixed gas.

Also, a phosphor material type, a discharge gas type, and a pressure are not limited to the above-mentioned ones, and a material and a condition which are usually used in an AC type PDP can be applied to the present invention.

(Shape and Effect of Bus Electrode 9)

The bus electrode 9 is formed by patterning and thinning in a minute pattern shape.

The bus electrode 9 crosses over the barrier rib 14 in the display area A. Therefore, as shown in FIGS. 2A and 2B, the bus electrode 9 has a discharge space part 92 which does not overlap with the barrier rib 14, and a barrier rib crossing part 93 which overlaps with the barrier rib 14 in a plan view. The patterning is performed on the bus electrode 9 of the first embodiment so that the barrier rib crossing part 93 has the projection 91. In other words, as shown in FIG. 2, a line width (vertical width) D1 of the projection 91 is formed so as to be larger than a line width D2 of the discharge space part 92.

Since the bus electrode 9 has the above-mentioned feature, the following effect can be obtained. In the above-mentioned bus electrode 9, the line width D1 is formed so as to be larger than the line width D2 of the discharge space part 92 because the projection 91 is formed in the barrier rib crossing part 93. However, it does not have an effect on a pixel aperture ratio because the barrier rib crossing part 93 overlaps with the barrier rib. As a result, a resistance (line resistance) of the bus electrode 9 in a longitudinal direction can be kept low while a pixel aperture ration is ensured.

In other words, when comparing the bus electrode 9 of the first embodiment with a bus electrode having a uniform width of D2, pixel aperture ratios are same because line widths in an area of the discharge space 1 are D2 and same. However, a line resistance in the barrier rib crossing part 93 can be kept low in the bus electrode 9 because the line width D1 of the barrier rib crossing part 93 is larger than the line width D2.

Especially, in a high-definition PDP, it is preferable that the discharge space part 92 is thinned and the line width D2 is maintained constant in order to ensure a pixel aperture ratio. As the line width D2, a range of 5 μm to 10 m is appropriate.

In a high-definition PDP, a profound effect of lowering a line resistance can be obtained if the above-mentioned bus electrode 9 is used.

In other words, in PDPs, if a display screen sizes are same, the higher the definition is, the smaller a unit pixel area is. Therefore, a line width of a bus electrode in a discharge space part is required to be considerably thin in order to maintain a pixel aperture ratio. For example, in a high-definition PDP for full high definition, as a whole panel, each of the number of the scan electrode 5 and the number of the sustain electrode 6 is equal to or larger than about 2000, and the number of the bus electrode 9 is equal to or larger than about 4000. Therefore, a bus electrode is required to be considerably thin.

In such high-definition PDP, if a whole bus electrode is formed so as to have a uniform line width, it is difficult to sufficiently supply electric power to an electrode edge because a line resistance becomes considerably high. However, in the bus electrode 9 of the first embodiment, since the projection 91 is provided in the barrier rib crossing part 93, a line width of the barrier rib crossing part 93 becomes larger and a line resistance (resistance for a X direction) becomes low. Therefore, even if a PDP is high-definition, a line resistance of a bus electrode can be kept low. As a result, enough electric power can be supplied to a bus electrode edge in an extending direction.

Next, a preferred embodiment of the projection 91 will be described in detail.

A whole shape of the projection 91 may be a rectangular shape as shown in FIG. 2A, or the projection 91 may be formed so that a root part is wider than a tip part as shown in FIG. 2B.

In any shape, when the projection 91 is projected in a Y direction in which the barrier rib 14 extends, the projection 91 overlaps with the barrier rib 14 even if being largely projected. Therefore, it is preferable for maintaining a pixel aperture ratio.

It is preferable to set a width W1 in a tip part (part excluding the vicinity of a root part) of the projection 91 to be same or smaller than a maximum width W2 of the barrier rib 14. This is because of the following reason. If the width W1 of a part other than the root part of the projection 91 is larger than the maximum width W2 of the barrier rib 14, the projection 91 protrudes from the barrier rib 14, and light emitted from a discharge cell to a front is shielded by the protruded part. As a result, a light emission amount from a discharge cell is reduced. However, if the width W1 of the projection 91 is set to be equal to or smaller than the maximum width W2 of the barrier rib 14, a light emission amount from a discharge cell is ensured.

Here, across section of the barrier rib 14 (cross section along the line Z-Z in FIG. 2A) is generally in a shape of a trapezoid as shown in FIG. 1. Since a width on a root side (substrate 11 side) is larger than a width of a barrier rib top (front panel 2 side), "the maximum width W2 of the barrier rib 14" is generally the width of the barrier rib 14 on the substrate 11 side. A line showing an edge of the barrier rib 14 in FIG. 2 indicates the maximum width W2.

On the other hand, a root part of the projection 91 is located in a corner of a discharge cell. If the width W1 of the root part is larger than the maximum width W2 of the barrier rib 14, the corner is shielded. However, since a discharge emission is hardly performed in the corner, it has a little effect on an amount of light emitted from a discharge cell to a front even if the corner is shielded. Therefore, even if the width W1 of the root part is larger than the maximum width W2 of the barrier rib 14, a substantial pixel aperture ratio is not reduced.

Thus, as shown in FIG. 2B, the width W1 of only the vicinity of the root part of the projection 91 is set to be larger than the maximum width W2 of the barrier rib 14, and the width W1 of a part other than the vicinity of the root part is set to be smaller than the maximum width W2 of the barrier rib 14. As a result, a line resistance of a bus electrode corresponding to the expansion of the width W1 in the vicinity of the root part can be further reduced without reducing a substantial pixel aperture ratio.

Also, if the barrier rib 14 has a curb construction, or a Xe partial pressure in a discharge gas is increased, it is difficult that a discharge expands in a corner of a discharge cell. Therefore, especially if a barrier rib has a curb construction, or a Xe partial pressure in a discharge gas is increased in a high-definition pixel, it is preferable to reduce a line resistance by setting the width W1 of the projection 91 in a tip part to be equal to or smaller than the maximum width of the barrier rib, and setting the width W1 of the projection 91 in a root part to be wider than the maximum width.

It is preferable to set the line width D1 of the projection 91 to be large in order to keep a line resistance of the bus electrode 9 low. However, if the line width D1 is set to be large so that a tip of the projection 91 protrudes from the transparent electrode 55, a discharge tends to occur between tips of the projection 91 in opposition to each other on a barrier rib when driving the PDP. Therefore, the line width D1 is set so that a tip of the projection 91 does not protrude from the transparent electrode 55.

From such point of view, it is preferable to set the line width D1 of the projection 91 to be in a range of twice to 20 times inclusive as large as the line width D2 of the discharge space part 92.

Also, if a display surface side of the bus electrode 9 is formed by a low reflectance material, when a ratio that the bus electrode 9 covers the barrier rib 14 is larger, a contrast is more improved. Therefore, it is preferable that the projection 91 extends to an edge on a discharge gap side of the transparent 55. Especially, if the light shielding film 102 is not provided, it is preferable that the projection 91 extends to the edge of the discharge gap side of the transparent 55.

As mentioned above, according to the PDP of the first embodiment, a line resistance of a bus electrode can be reduced without reducing a pixel aperture ratio. In addition, the PDP may be applied to a low-definition PDP. However, if the PDP is applied to a high-definition PDP (for full high definition) having a large screen in a range of 50 inches to 100 inches or more, a profound effect can be obtained.

Note that in the above-mentioned explanation, the display electrode pair 4 is formed by laminating the transparent electrode 55 and the bus electrode 9. However, the present invention is practicable and has the same effect if the display electrode pair 4 is composed of only a bus electrode pair 9 without forming the transparent electrode 55.

Second Embodiment

Figure 3:
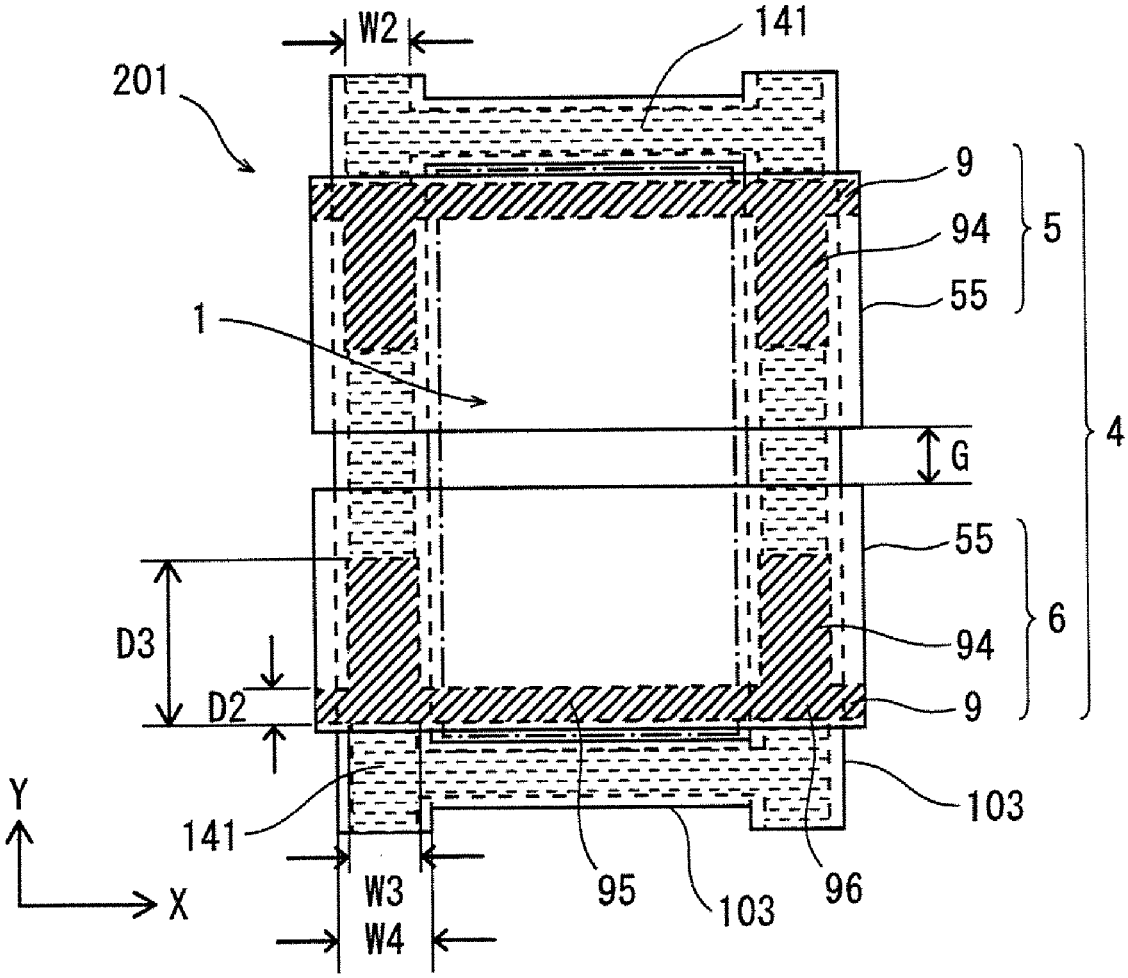
FIG. 3 is a schematic plan view showing a construction example of a discharge cell unit of a PDP of a second embodiment of the present invention.

FIG. 3 is a schematic plan view showing a construction of a discharge cell unit of a PDP of a second embodiment of the present invention, and the same numbers as in FIG. 2 are assigned to the same component parts.

As in the case of the first embodiment, the discharge space part 95 (an area facing the discharge space 1 in the display area A) in the bus electrode 9 is thinned so that the line width D2 is in a range of 5 μm to 10 μm inclusive, and is formed so that the line width (vertical width) D3 of the projection 94 is larger than the line width D2 of the discharge space part 95. However, in the second embodiment, a barrier rib 141 is formed in a curb shape, and a light shielding film 103 in a black matrix shape is formed so as to surround a discharge cell same as the barrier rib 141. In association with this, the bus electrode 9 crosses over the barrier rib 141 and the light shielding film 103 in a plan view as shown in FIG. 3. The projection 94 is formed in the crossing part, and the width W3 of a tip part of the projection 94 is set to be smaller than a width W4 of the light shielding film 103.

The display electrode pair 4 may be formed by laminating the transparent electrode 55 and the bus electrode 9. Also, the display electrode pair 4 may be composed of only a bus electrode pair 9 without forming the transparent electrode 55.

The following is a more detailed explanation.

As shown in FIG. 3, the barrier rib 141 of the back panel 3 is formed in a curb shape around a discharge cell 201. On the other hand, on the front panel 2, the light shielding film 103 in a black matrix shape is formed so as to cover the barrier rib 141 in a curb shape. In other words, the light shielding film 103 is formed so as to overlap with the barrier rib 141 in a plan view. The light shielding film 103 exists between adjacent discharge cells, and improves a display contrast by shielding light around the discharge cell 201 and near a boundary between discharge cells.

If each of color filters (not illustrated) of RGB is provided for each pixel, the light shielding film 103 may be provided between the color filters of RGB.

The width W4 of a part formed along a Y direction of the light shielding film 103 is set to be slightly wider than the maximum width W2 of a part formed along a Y direction of the barrier rib 141.

The bus electrode 9 is extended to an X direction which is a screen horizontal direction. Therefore, the bus electrode 9 crosses over the barrier rib 141 and the light shielding film 103 extending to a Y direction which is a screen vertical direction in the display area A in a plan view.

In a light shielding film crossing part 96 in which the bus electrode 9 crosses over and overlaps with the light shielding film 103, the projection 94 is formed. As a result, the line width D3 of the projection 94 is larger than the line width D2 of the discharge space part 95.

The width W3 of a tip part of the projection 94 is set to be equal to or smaller than the width W4 of the light shielding film 103. Note that if the width W3 of a tip part of the projection 94 is set to be equal to or smaller than the maximum width W2 of the barrier rib 141, the width W3 is set to be equal to or smaller than the width W4 of the light shielding film 103.

When the projection 94 is projected in a Y direction in which the light shielding film 103 extends, the projection 94 overlaps with the light shielding film 103 even if being largely projected. Therefore, it is preferable for maintaining a pixel aperture ratio.

The PDP of the second embodiment has the same effect as the first embodiment.

In other words, the discharge space part 95 in the bus electrode 9 is thinned, and the projection 94 overlaps with the light shielding film 103 in a plan view. Therefore, a pixel aperture ratio can be maintained. Also, a line resistance of the bus electrode 9 is kept low by the projection 94. As a result, enough electric power can be supplied to a bus electrode edge in an extending direction.

The above-mentioned effect is effective for a low-definition PDP. However, in a high-definition PDP (for full high definition, for example) having a large screen especially in a range of 50 inches to 100 inches or more, the effect becomes prominent.

Modification of Second Embodiment

In an example shown in FIG. 3, the projection 94 is in a rectangular shape, and a whole width W3 of the projection 94 is set to be equal to or smaller than the width W4 of the light shielding film 103. However, as described in the first embodiment based on FIG. 2B, if the width W3 of a root part of the projection 94 is set to be larger than the width W4 of the light shielding film 103, a line resistance can be lower.

Also, the PDP shown in FIG. 3 is formed so that the light shielding film 103 overlaps with the barrier rib 141 in a plan view, and the bus electrode 9 crosses over both the light shielding film 103 and the barrier rib 141. However, the barrier rib 141 is not required to cross the bus electrode 9, and the PDP is practicable if the light shielding film 103 crosses over the bus electrode 9.

Moreover, in the PDP shown in FIG. 3, the light shielding film 103 is formed in a curb shape. However, the PDP is practicable and has the same effect if the light shielding film 103 is formed only along the Y direction.

Third Embodiment

Figure 4:
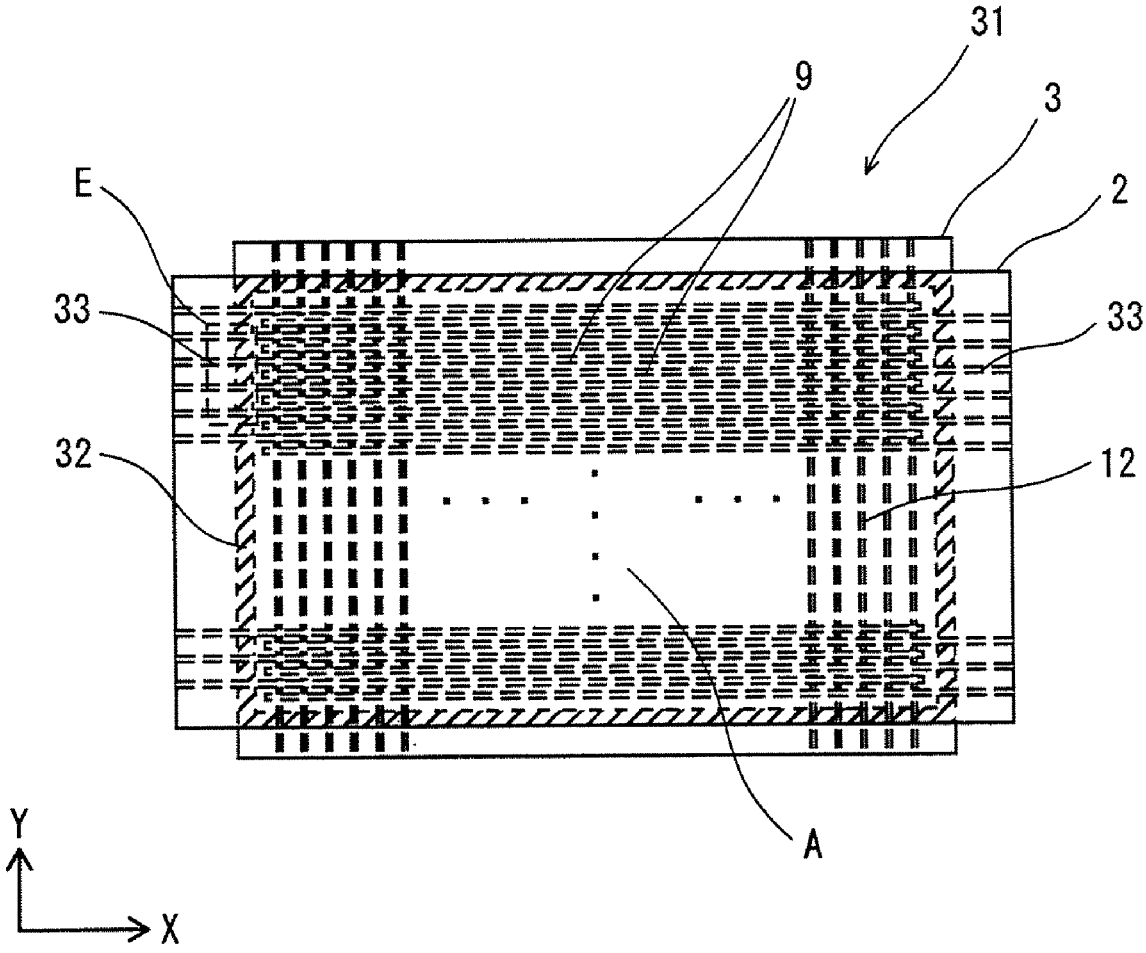
FIG. 4 is a schematic plan view showing a whole construction of a panel of a PDP of a third embodiment of the present invention.

FIG. 4 is a schematic plan view showing a whole construction of a panel of a PDP of a third embodiment of the present invention, and the same numbers as in FIGS. 1 and 2 are assigned to the same component parts.

In FIG. 4, the following arrangement construction of a PDP 31 is shown. The bus electrode 9 is arranged in a longitudinal direction k of the front panel 2, the data electrode 12 is arranged in a screen vertical direction Y of the back panel 3, and a sealing part 32 is arrange on a periphery portion of a substrate for sealing the substrates.

The PDP 31 is a high-definition PDP, and in the display area A, more discharge cells described in the first and second embodiments are arranged than a conventional low-definition PDP. Therefore, each of the number of the bus electrode 9 and the number of the data electrode 12 is considerably large, and an arrangement pitch of the bus electrode 9 is set to be smaller than about one third of a conventional low-definition pitch. Also, the number of electrode draw-out parts 33 which are drawn from the bus electrode 9 extended and formed in the display area A to a substrate edge is increased, and an arrangement pitch of an outside of the display area becomes narrower than a conventional technology. In the same manner as this, the number of the data electrodes 12 of the back panel 3 is also increased.

Figure 5A:
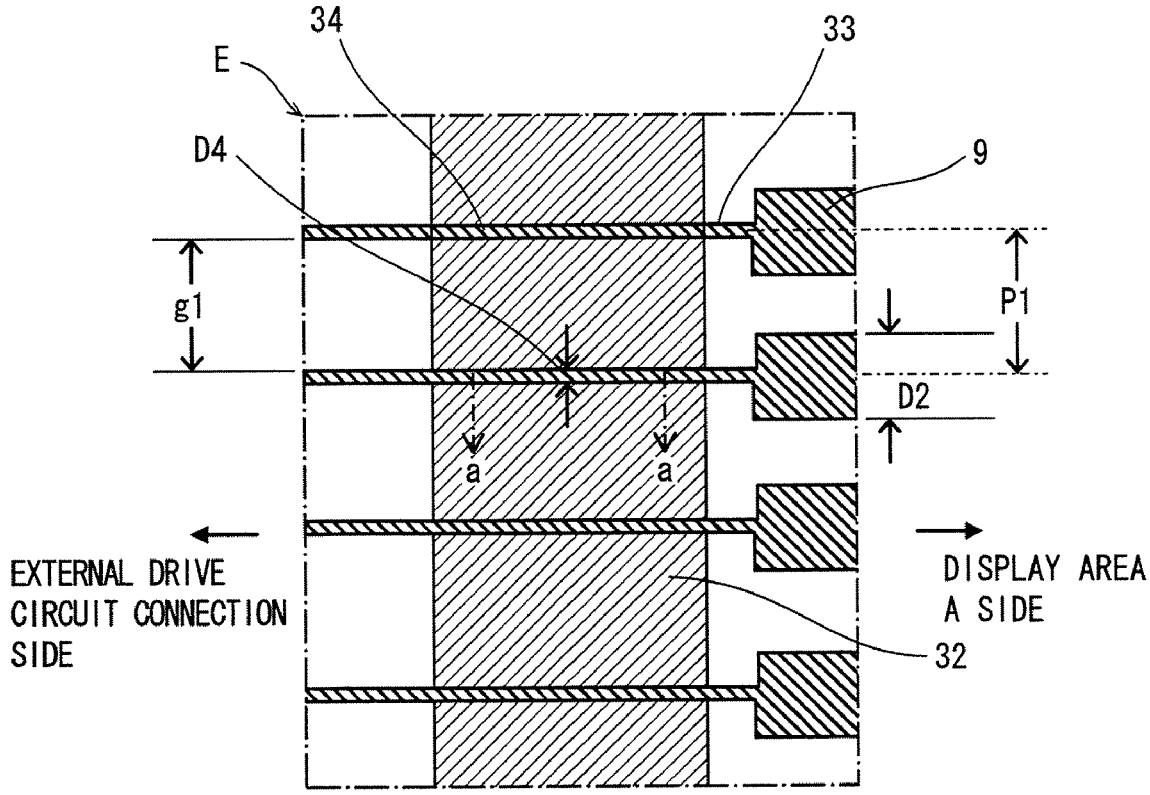
FIG. 5A is a schematic plan view showing a construction of an electrode draw-out part from a bus electrode in a sealing part of the PDP of the third embodiment of the present invention.

FIG. 5 shows a construction of an electrode draw-out part from a bus electrode in a sealing part of the PDP 31, and FIG. 5A is a plan view conceptually showing an enlarged area E near the sealing part 32 of an outside of the display area of the PDP 31 shown in FIG. 4.

As shown in FIG. 5A, in the area E, the sealing part 32 is formed on a periphery of the substrate. The sealing part 32 is applied by printing with a sealing material (seal material), and cured.

A sealing material can be selected from a proper organic material, an inorganic material, or a composite material of an organic material and an inorganic material, depending on a usage situation. For example, a composite material in which at least two types of materials out of an organic resin material, an inorganic material, and a metal material can be used. By using these materials, it is possible to seal substrates in a low-temperature process in a range of a room temperature to about 300° C. inclusive. Therefore, the panel quality can be improved, and a cost of the manufacturing process can be reduced.

More specifically, as a high airtight composite material, the following materials can be used. The materials are: (i) an acrylate series ultraviolet cure adhesive including more whiskers and a powder composed of an inorganic material such as a metal oxide like SiO2 and a glass, a metal nitride, and a metal carbide, (ii) a cation cure type ultraviolet cure epoxy resin adhesive including more whiskers and a powder composed of an inorganic material such as a metal oxide like SiO2 and a glass, a metal nitride, and a metal carbide, (iii) ultraviolet cure organic adhesive material containing a high proportion of these inorganic materials, (iv) ultraviolet cure organic adhesive material containing a low proportion of these inorganic materials, (v) an acrylate series ultraviolet cure adhesive not including an inorganic material, and (vi) a cation cure type ultraviolet cure epoxy resin adhesive not including an inorganic material.

The bus electrode 9 has the electrode draw-out part 33 which is drawn from the display area A, and the electrode draw-out part 33 is extended to an outside of the display area across the sealing part 32.

The bus electrode 9 is a metal electrode as described in the first and second embodiments. It is preferable that the bus electrode 9 is a thin film electrode formed by an electrode material including at least one material selected from the group consisting of Al, Cu, Cr, Ni, Au, and Pd. For example, it is preferable to use a thin film electrode by an Al series electrode material, and a laminated thin film electrode such as Cr/Cu/Cr.

(Characteristic of Electrode Draw-Out Part 33)

In a high-definition PDP, the line width D2 of the bus electrode 9 and an arrangement pitch P1 are set to be small. For example, the line width D2 of the bus electrode 9 is set to be about 20 μm, and the arrangement pitch P1 is set to be about 80 μm. In this case, a gap between the bus electrodes 9 is about 60 μm. However, if a gap between sealing crossing parts is narrow such as about 60 μm, an electromigration phenomenon is caused easily because an electric field occurs in the narrow gap. If an electromigration phenomenon occurs in a sealing part, the sealing part is degraded, and an electric current leak and a gas leak occur.

On the other hand, in the PDP of the third embodiment, the line width D4 of the sealing crossing part 34 in the electrode draw-out part 33 which is drawn from the bus electrode 9 is smaller than the line width D2 of the bus electrode 9 which is extended in the display area A, and is set to be in a range of 5 μm to 10 μm inclusive.

As mentioned above, if the line width D4 of the sealing crossing part 34 is set to be smaller than the line width D2 in the display area, a conductive property of a bus electrode can be ensured in the display area, and an electric field hardly occurs between adjacent electrode draw-out parts 33 because the line width of the sealing crossing part 34 is set to be small and a gap g1 between adjacent sealing crossing parts 34 becomes wider such as about 70 μm to 75 μm.

Therefore, in a high-definition PDP, electric power consumption can be reduced, and an electromigration phenomenon can be suppressed. As a result, an electric current leak and a gas leak in a sealing part can be suppressed. This is effective for improving reliability.

Also, the sealing crossing part 34 of the electrode draw-out part 33 is formed by a thin film electrode composed of an electrode material including at least one material selected from the group consisting of Al, Cu, Cr, Ni, Au, and Pd. This is also effective for preventing an electromigration phenomenon in a sealing crossing part.

Note that as shown in FIG. 5A, the electrode draw-out part 33 is extended to an outside through the sealing part 32. However, a thick film electrode may be formed so as to contact with each thin film electrode outside of the sealing part 32.

Figure 5B:
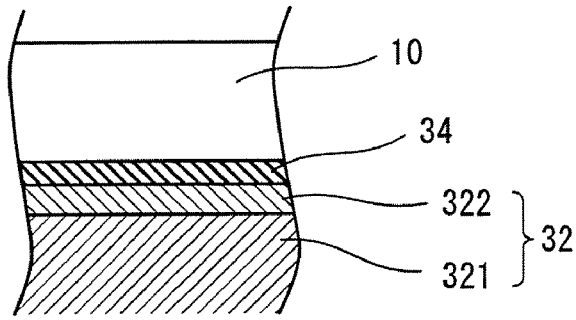
FIG. 5B is a cross sectional view of a sealing crossing part along the line a-a.

FIG. 5B is a cross sectional view of the sealing crossing part in the bus electrode shown in FIG. 5A along the line a-a.

In the sealing part 32, if a sealing part 322, which crosses over and contacts with the electrode draw-out part 33, is formed by a composite material including an organic material and an inorganic material, a leak in the sealing part can be prevented. This is preferable for improving reliability of a panel.

On the other hand, regarding to a sealing part 321 which crosses over the electrode draw-out part 33, but does not contact with the electrode draw-out part 33, a sealing material including at least one group of an organic material and a composite material may be used. Then, the present invention may have a laminated construction in which the sealing part 32 is formed by laminating the sealing part 322 and the sealing part 321 as shown in FIG. 5B.

Up to now, the bus electrode 9 of a display electrode pair has been described through the embodiments. However, as in the case of the electrode draw-out part which is drawn from the data electrode 12, if a line width of the sealing crossing part is set to be smaller than a line width of the data electrode 12 which is extended to an inside of a display area, an electric field occurring between adjacent electrode draw-out parts becomes low. Therefore, an electromigration phenomenon can be suppressed.

Modification of First, Second, and Third Embodiments

In the Above-Mentioned First to Third Embodiments, the bus electrode in the display area is a thin film electrode formed by mainly an Al series electrode material. However, the bus electrode may be a thick film electrode formed by a thick film process in which a thick film electrode material such as an Ag electrode paste is printed and calcined.

Also, in the first to third embodiments, the protection film is formed by MgO. However, the present invention is practicable if the protection film is formed by other metal oxide such as CaO, BaO, SrO, MgNO, and ZnO.

INDUSTRIAL APPLICABILITY

According to the present invention, especially in a high-definition PDP, a high-definition PDP having a high luminance and low electric power consumption can be realized by keeping an electrode resistance low without lowering a pixel aperture ratio. Also, reliability can be improved by preventing an electromigration phenomenon in an electrode draw-out part. Therefore, the present invention can be used for an image equipment industry, an information equipment industry, and other industries such as a high-definition television from a small and a medium sizes to a large size, or a high-definition information display edge. As a result, the present invention can have a great deal of potential in industry.

The invention claimed is:

1. A plasma display panel including a front panel and a back panel arranged in opposition to each other with a discharge space therebetween, a display electrode pair including a bus electrode being arranged on the front panel, a plurality of discharge cells being formed in a display area along the display electrode pair, and a barrier rib for separating adjacent discharge cells being arranged on the back panel so as to cross over the display electrode pair, wherein the bus electrode has a projection in a part that overlaps with the barrier rib, a line width of the bus electrode is larger in a part that includes the projection than in a part that faces the discharge space, and a width of the projection in a part other than a vicinity of a root part is equal to or smaller than a maximum width of the barrier rib and a width of the root part is larger than the maximum width of the barrier rib, so that the root part extends beyond the barrier rib in a width direction toward the discharge space.

2. A plasma display panel including a front panel and a back panel arranged in opposition to each other with a discharge space therebetween, a display electrode pair including a bus electrode being arranged on the front panel, a plurality of discharge cells being formed in a display area along the display electrode pair, and a barrier rib for separating adjacent discharge cells being arranged on the back panel so as to cross over the display electrode pair, wherein the bus electrode has a projection in a part that overlaps with the barrier rib, a line width of the bus electrode is larger in a part that includes the projection than in a part that faces the discharge space, and a width of a tip part of the projection is smaller than a maximum width of the barrier rib and a width of a root part is larger than the maximum width of the barrier rib, so that the root part extends beyond the barrier rib in a width direction toward the discharge space.

3. The plasma display panel of claim 1, wherein the projection projects along the barrier rib.

4. The plasma display panel of claim 1, wherein a display surface side of the bus electrode is formed by a low reflectance material.

5. A plasma display panel including a front panel and a back panel arranged in opposition to each other with a discharge space therebetween, a display electrode pair including a bus electrode being arranged on the front panel, a plurality of discharge cells being formed in a display area along the display electrode pair, and a light shielding film for shielding light near a boundary area of adjacent discharge cells being arranged on the front panel so as to cross over the display electrode pair, wherein the bus electrode has a projection in a part that overlaps with the light shielding film, a line width of the bus electrode is larger in a part that includes the projection than in a part that faces the discharge space, a width of the projection is equal to or smaller than a width of the light shielding film, and a width of a root part of the projection is larger than the width of the light shielding film, so that the root part extends beyond the light shielding film in a width direction toward the discharge space.

6. A plasma display panel including a front panel and a back panel arranged in opposition to each other with a discharge space therebetween, a display electrode pair including a bus electrode being arranged on the front panel, a plurality of discharge cells being formed in a display area along the display electrode pair, and a light shielding film for shielding light near a boundary area of adjacent discharge cells being arranged on the front panel so as to cross over the display electrode pair, wherein the bus electrode has a projection in a part that overlaps with the light shielding film, a line width of the bus electrode is larger in a part that includes the projection than in a part that faces the discharge space, a width of a tip part of the projection is smaller than a width of the light shielding film, and a width of a root part of the projection is larger than the width of the light shielding film, so that the root part extends beyond the light shielding film in a width direction toward the discharge space.

7. The plasma display panel of claim 5, wherein the projection projects along the light shielding film.

8. The plasma display panel of claim 1, wherein the line width of the bus electrode in the part that includes the projection is in a range of twice to 20 times inclusive as large as the line width of the bus electrode in the part that faces the discharge space.

9. The plasma display panel claim 1, wherein each display electrode of the display electrode pair is composed of a belt-like transparent electrode and the bus electrode which is formed on the belt-like transparent electrode, and the projection extends to a discharge gap side edge of the transparent electrode.

10. A plasma display panel including a front panel and a back panel arranged in opposition to each other with a discharge space therebetween, and being sealed by a sealing part provided on entire peripheral portions of main surfaces of the front panel and the back panel, a display electrode pair including a bus electrode being arranged on the front panel, a plurality of discharge cells being formed in a display area along the display electrode pair, and an electrode thaw-out part being formed by drawing the bus electrode from an inside to an outside of the display area across the sealing part, wherein a line width of the bus electrode in a part that crosses over the sealing part is smaller than a line width in the display area and is in a range of 5 μm to 10 μm, inclusive.

11. The plasma display panel of claim 10, wherein at least a part of the bus electrode that crosses over the sealing part is formed by a thin film composed of an electrode material including at least one material selected from the group consisting of Al, Cu, Cr, Ni, Au, and Pd.

12. The plasma display panel of claim 10, wherein the sealing part is formed by a composite material including an organic material and an inorganic material.

13. The plasma display panel of claim 10, wherein at least a part of the sealing part that crosses and contacts with the electrode draw-out part is formed by a composite material including an organic material and an inorganic material.

14. The plasma display panel of claim 10, wherein the sealing part is formed under a temperature condition in a range of a room temperature to 300° C. inclusive.

15. The plasma display panel of claim 1, wherein a part of the bus electrode in the display area is formed by a thin film composed of an electrode material including at least one material selected from the group consisting of Al, Cu, Cr, Ni, Au, and Pd.

16. The plasma display panel of claim 1, wherein in the display area, the bus electrode is formed by a thick film composed of an electrode material including Ag.

17. The plasma display panel of claim 2, wherein the projection projects along the barrier rib.

18. The plasma display panel of claim 2, wherein a display surface side of the bus electrode is formed by a low reflectance material.

19. The plasma display panel of claim 6, wherein the projection projects along the light shielding film.

20. The plasma display panel of claim 2, wherein the line width of the bus electrode in the part that includes the projection is in a range of twice to 20 times inclusive as large as the line width of the bus electrode in the part that faces the discharge space.

21. The plasma display panel of claim 5 wherein the line width of the bus electrode in the part that includes the projection is in a range of twice to 20 times inclusive as large as the line width of the bus electrode in the part that faces the discharge space.

22. The plasma display panel of claim 6 wherein the line width of the bus electrode in the part that includes the projection is in a range of twice to 20 times inclusive as large as the line width of the bus electrode in the part that faces the discharge space.

23. The plasma display panel claim 2, wherein each display electrode of the display electrode pair is composed of a belt-like transparent electrode and the bus electrode which is formed on the belt-like transparent electrode, and the projection extends to a discharge gap side edge of the transparent electrode.

24. The plasma display panel claim 5, wherein each display electrode of the display electrode pair is composed of a belt-like transparent electrode and the bus electrode which is formed on the belt-like transparent electrode, and the projection extends to a discharge gap side edge of the transparent electrode.

25. The plasma display panel claim 6, wherein each display electrode of the display electrode pair is composed of a belt-like transparent electrode and the bus electrode which is formed on the belt-like transparent electrode, and the projection extends to a discharge gap side edge of the transparent electrode.

26. The plasma display panel of claim 2, wherein a part of the bus electrode in the display area is formed by a thin film composed of an electrode material including at least one material selected from the group consisting of Al, Cu, Cr, Ni, Au, and Pd.

27. The plasma display panel of claim 5, wherein a part of the bus electrode in the display area is formed by a thin film composed of an electrode material including at least one material selected from the group consisting of Al, Cu, Cr, Ni, Au, and Pd.

28. The plasma display panel of claim 6, wherein a part of the bus electrode in the display area is formed by a thin film composed of an electrode material including at least one material selected from the group consisting of Al, Cu, Cr, Ni, Au, and Pd.

29. The plasma display panel of claim 10, wherein a part of the bus electrode in the display area is formed by a thin film composed of an electrode material including at least one material selected from the group consisting of Al, Cu, Cr, Ni, Au, and Pd.

30. The plasma display panel of claim 2, wherein in the display area, the bus electrode is formed by a thick film composed of an electrode material including Ag.

31. The plasma display panel of claim 5, wherein in the display area, the bus electrode is formed by a thick film composed of an electrode material including Ag.

32. The plasma display panel of claim 6, wherein in the display area, the bus electrode is formed by a thick film composed of an electrode material including Ag.

33. The plasma display panel of claim 10, wherein in the display area, the bus electrode is formed by a thick film composed of an electrode material including Ag.

34. The plasma display panel of claim 10 further includes a barrier rib for separating adjacent discharge cells being arranged on the back panel so as to cross over the display electrode pair, wherein the bus electrode has a projection in a part that overlaps with the barrier rib, a line width of the bus electrode is larger in a part that includes the projection than in a part that faces the discharge space, and a width of the projection is equal to or smaller than a maximum width of the barrier rib.

35. The plasma display panel of claim 10 further includes a barrier rib for separating adjacent discharge cells being arranged on the back panel so as to cross over the display electrode pair, wherein the bus electrode has a projection in a part that overlaps with the barrier rib, a line width of the bus electrode is larger in a part that includes the projection than in a part that faces the discharge space, and a width of a tip part of the projection is smaller than a maximum width of the barrier rib.

36. The plasma display panel of claim 10 further includes a light shielding film for shielding light near a boundary area of adjacent discharge cells being arranged on the front panel so as to cross over the display electrode pair, wherein the bus electrode has a projection in a part that overlaps with the light shielding film, a line width of the bus electrode is larger in a part that includes the projection than in a part that faces the discharge space, and a width of the projection is equal to or smaller than a width of the light shielding film.

37. The plasma display panel of claim 10 further includes a light shielding film for shielding light near a boundary area of adjacent discharge cells being arranged on the front panel so as to cross over the display electrode pair, wherein the bus electrode has a projection in a part that overlaps with the light shielding film, a line width of the bus electrode is larger in a part that includes the projection than in a part that faces the discharge space, and a width of a tip part of the projection is smaller than a width of the light shielding film.

* * * * *